United States Patent [19]

McBrady

[11] Patent Number: 4,834,123

[45] Date of Patent: May 30, 1989

[54] BOTTLE WASHER USING A 360 DEGREE ARC AND EXTENDED PADDLES TO CONTROL THE BOTTLES' MOVEMENT

[76] Inventor: William J. McBrady, 2902 Bob-O-Link Rd., Flossmoor, Ill. 60422

[21] Appl. No.: 106,627

[22] Filed: Oct. 6, 1987

[51] Int. Cl.[4] ..... B08B 3/02; B08B 9/08

[52] U.S. Cl. ..... 134/134; 15/304; 134/152; 134/159; 198/404; 198/778

[58] Field of Search ..... 15/304, 306 B; 134/62, 134/79, 133, 134, 152, 159; 198/404, 410, 778; 141/171

[56] References Cited

U.S. PATENT DOCUMENTS

| | | | |
|---|---|---|---|
| 1,354,635 | 10/1920 | Weiss | 141/171 X |
| 1,717,998 | 6/1929 | Olmsted | 134/79 |
| 1,997,792 | 4/1935 | Holmquist | 134/152 X |
| 2,066,283 | 12/1936 | Wadman | 15/304 X |
| 2,255,615 | 9/1941 | Frankel | 15/306 B X |
| 2,298,475 | 10/1942 | Fechheimer | 15/304 X |
| 2,304,050 | 12/1942 | Risser | 15/304 |
| 2,834,453 | 5/1958 | Domensino | 198/778 |
| 3,159,164 | 12/1964 | McBrady | 15/304 X |

*Primary Examiner*—Philip R. Coe
*Attorney, Agent, or Firm*—Eugene F. Friedman

[57] ABSTRACT

A bottle washer removing bottles from a conveyor, rotating them about 360 degrees, and using paddles of extended length and a stationary guide to replace the bottles on the conveyor. The washer may sit over the conveyor transporting the bottles. The conveyor moves the bottles between paddles which will rotate them through a circle of 360 degrees. At the very end of that arc, however, an obstructing guide rail directs the bottles out of the rotational plane to avoid their colliding with the entering bottles. The paddles that move the bottles about the arc have extensions lying in the direction that the conveyor moves. These extensions control the motion of the bottles as they move out of their plane of rotation so that they will return to the conveyor. The bottle washer, to work at greater length upon the bottles, may in fact move the bottles about two circles of approximately 360 degrees each. As the bottles complete the first rotation, the obstructing guide moves them out of the plane of the first rotation. The paddles of the second rotation make contact with them and move them around a second rotation. As they complete the second orbit, a second obstructing guide moves them out of that second plane. The extensions on the paddles of the second plane then direct the departing bottles onto the conveyor.

26 Claims, 3 Drawing Sheets

FIG. 1
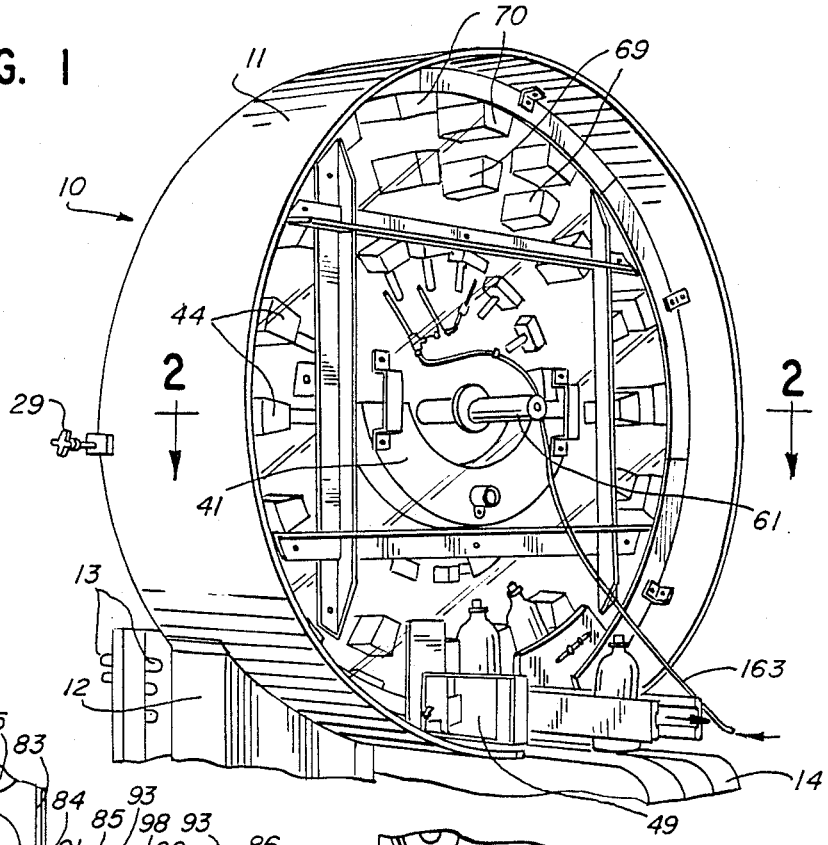
FIG. 4
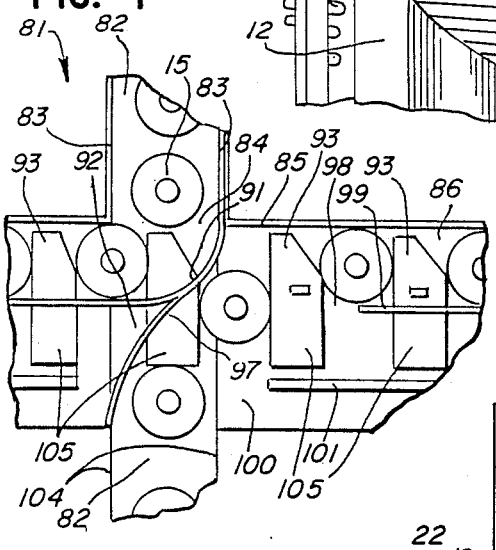
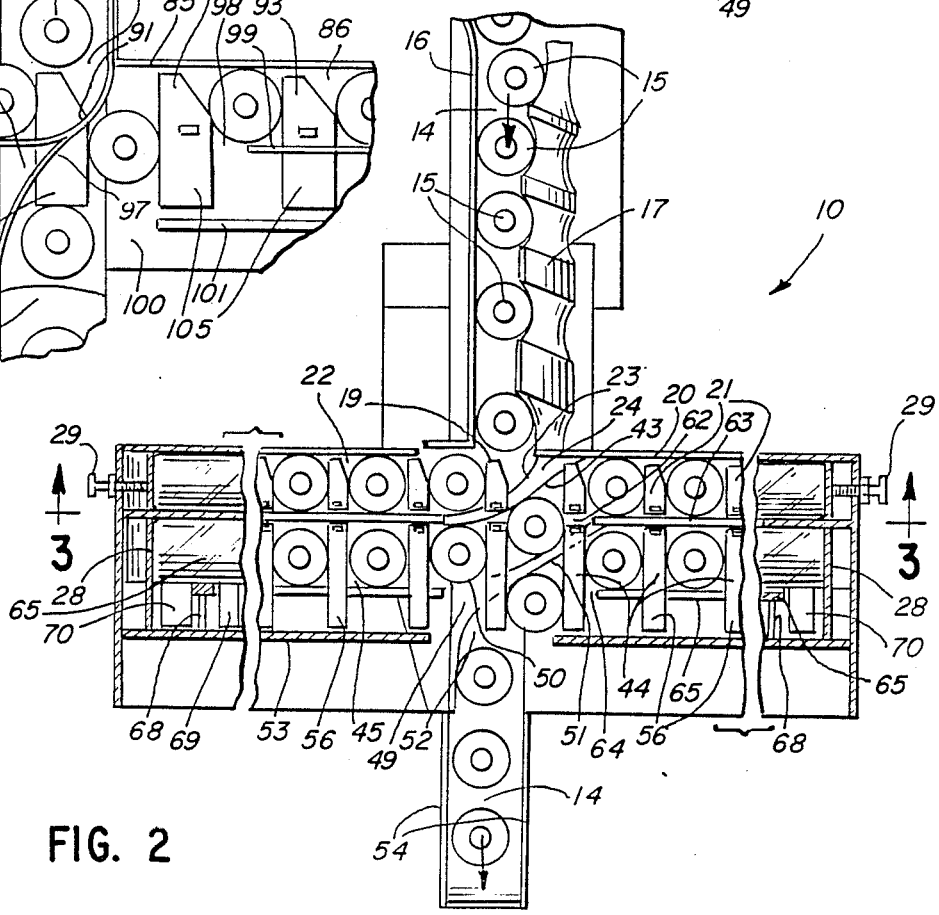
FIG. 2

FIG. 3
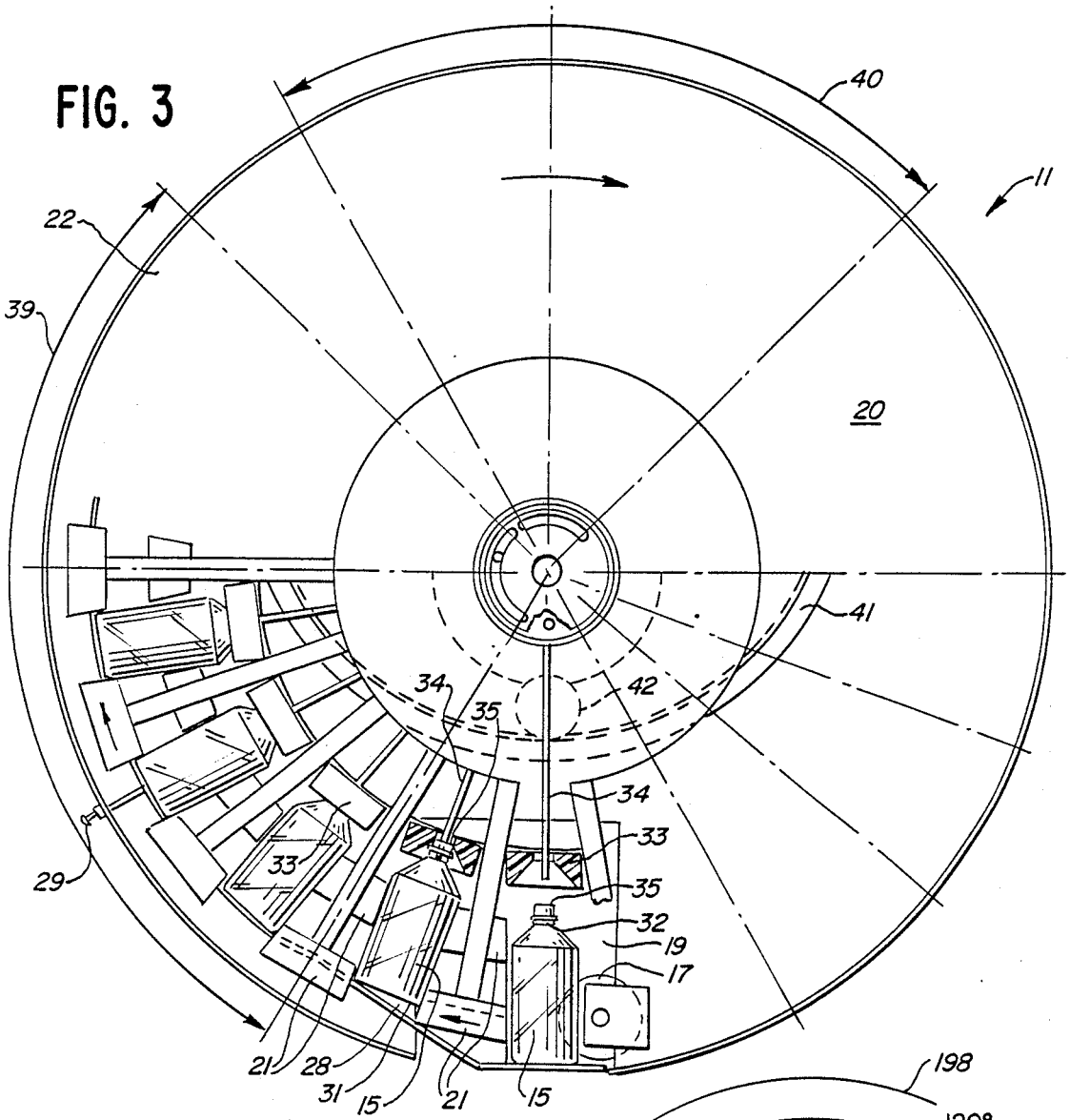
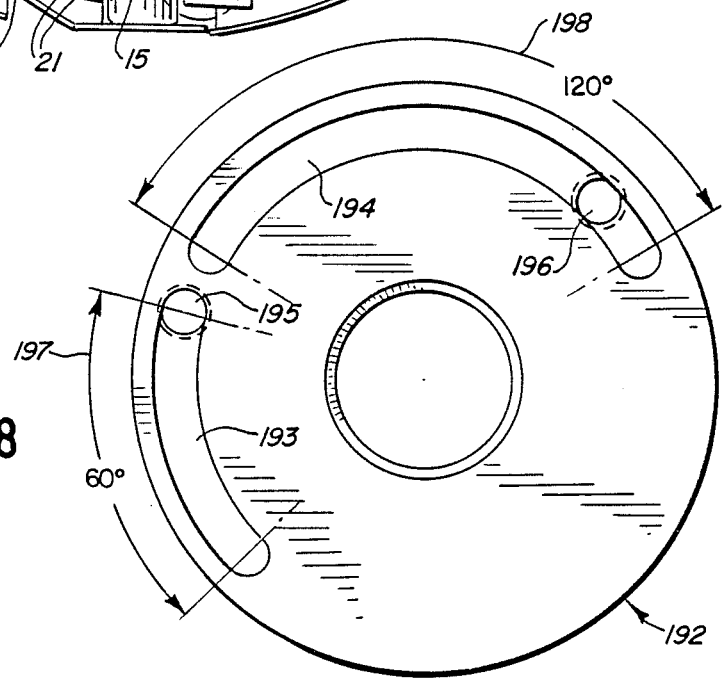
FIG. 8

FIG. 5
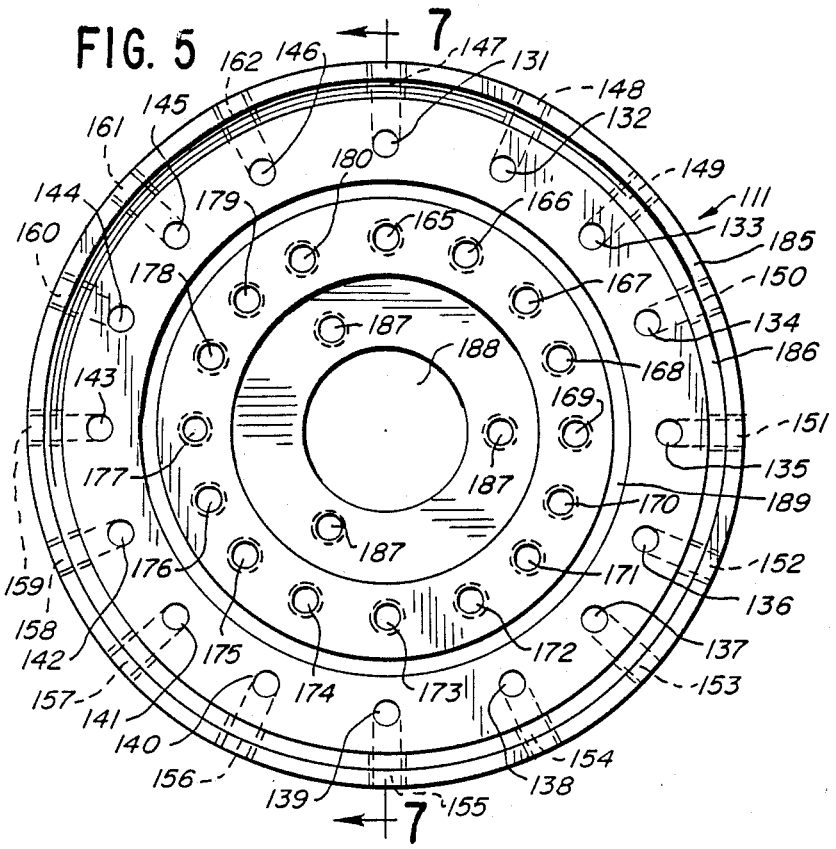
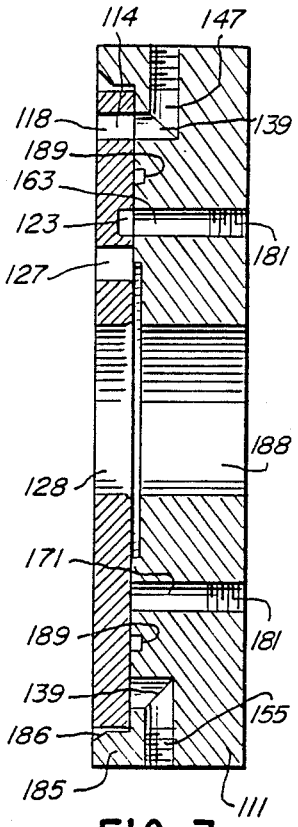
FIG. 7
FIG. 6
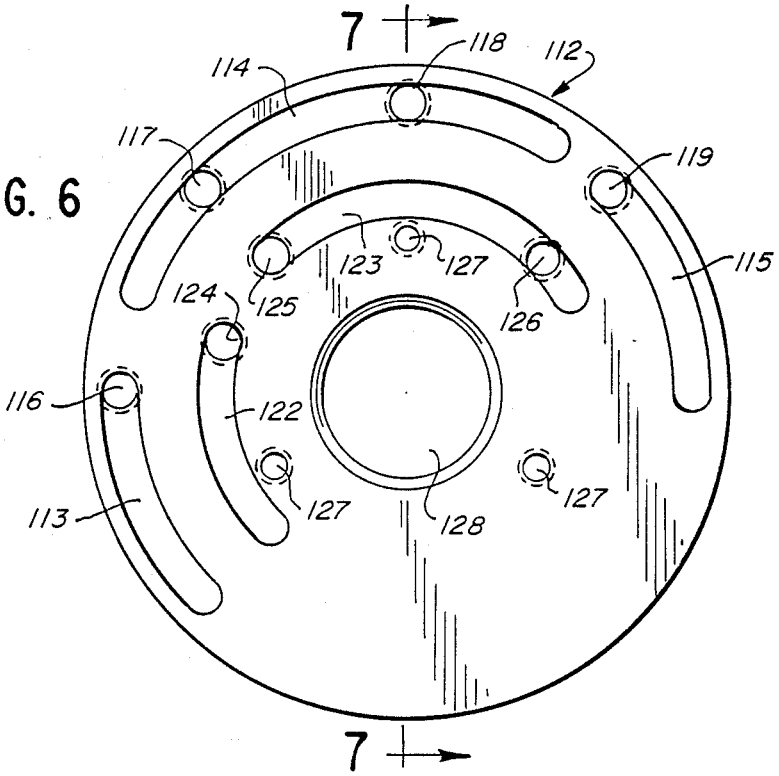

BOTTLE WASHER USING A 360 DEGREE ARC AND EXTENDED PADDLES TO CONTROL THE BOTTLES' MOVEMENT

BACKGROUND

Substantially all bottles and other containers, prior to their use, must undergo cleaning. Naturally, this would apply to previously used bottles prior to refilling. However, even new bottles typically must submit to a cleaning prior to their first use; this will serve to remove various types of unacceptable dirt such as dust, remnants of the raw materials forming the bottle, and the like.

Furthermore, the operator filling the bottles typically has them moving on a conveyor line. His preference would have cleaning equipment operating upon the bottles on the conveyor without the necessity of extending the length of or adding additional segments to the processing line. This would indicate the use of equipment that removes the bottles from the conveyor, appropriately cleans them, and replaces them upon the same conveyor ready for subsequent use.

U.S. Pat. No. 2,255,615 to E. M. Frankel shows an apparatus for pneumatically cleaning bottles. This equipment, however, requires several conveyors dedicated to its own use. The equipment takes the various bottles, rotates them through an arc of about 360 degrees, cleans them, and places them on a separate conveyor. It utilizes spring loaded guides in an attempt to keep the bottles moving into and out of the equipment Different sized bottles, however, as well as bottles with shapes other than circular may clog the equipment either at its input or its output.

Joseph K McBrady, in his U.S. Pat. No. 3,159,164, showed a device for cleaning containers that provided several significant improvements. First, the construction permitted its placement directly over an already existing conveyor line. There, it removed the bottles from the conveyor, rotated them about an arc of 360 degrees, cleaned them, and replaced them upon the same conveyor.

McBrady's apparatus accomplishes its task without creating a traffic jam at the equipment's entrance and exit. He does this by utilizing double-width equipment with two separate sections Each section has the capability of carrying the bottles through an arc of rotation. The entering bottles travel 270 degrees in the first half of the equipment and undergo their cleaning there. The equipment then transfers them to the second orbit, which has the function merely of replacing them on the conveyor. By moving the bottles from the first orbit to the second orbit prior to their complete circle of travel, the equipment replaces them upon the conveyor without bringing them into conflict with the bottles entering the equipment from the upstream conveyor line. While McBrady's equipment necessitates the use of additional equipment for the second orbit, it did accomplish the purpose of removing containers off a conveyor and replacing upon that same conveyor without creating conflicts or jamming at the entrance and departure points of his equipment.

U.S. Pat. No. 3,516,108 to G. F. Loeffler shows a bottle cleaner that can remove containers from a conveyor and replace them upon that same line. It permits the external adjustment of the width of the path within the cleaning equipment itself to accommodate bottles of different size.

Loeffler's equipment removes the bottle upstream on the conveyor, rotates them through an arc of almost 360 degrees, and replaces them upon the same conveyor. In an effort to avoid creating a traffic jam at the junction at the equipment with the conveyor, Loeffler first offsets the exit opening slightly from that of the entrance opening in the direction from which the bottles travel as they pass through the arc. Secondly, Loeffler uses various stationary guides in an effort to direct the bottles off the cleaning equipment prior to their coming into conflict with the entering bottles. However, containers of different size or noncircular configuration may still create an unacceptable traffic jam at the equipment's entrance or exit.

Thus, various types of bottle cleaning equipment have found use in the past. Most of them will work for a particular size and configuration of bottle or container. McBrady's equipment works for a variety of bottles, but does require some additional construction. Accordingly, the search continues for an efficient versatile bottle cleaning equipment that will work on containers moving along a conveyor line.

SUMMARY

Typically a bottle washer which cleans bottles or other containers moving in a particular direction on the conveyor includes some device first for directing bottles off of the conveyor at a particular location. Further, the cleaner will incorporate a capturing device, coupled to the bottle remover, for receiving bottles directed off of the conveyor.

A moving mechanism, coupled to the capturing device, then rotates the bottles received by the capturing device through an arc of substantially 360 degrees about an axis in a single plane. The arc need not amount to an entirely full circle of 360 degrees, but will come very close to it.

To accomplish the primary task, a washing device couples to the moving mechanism and cleans the bottles while rotating about the arc. At times, the operator may wish to perform tasks other than cleaning on the bottles. Accordingly, the equipment may not have a washing device whatsoever. However, it may still handle the bottles in the same fashion with the same components other than the cleaning device. Lastly, a depositing device couples to the moving mechanism and replaces on the conveyor the bottles rotated through the arc. The bottles may take the form of almost any container.

An improvement to this general type of bottle washing or handling equipment results through the use of a guiding mechanism which couples to the removal device, the moving mechanism, and to the depositing device This guiding mechanism includes two parts. The first of these parts couples to and rotates about the arc of the moving mechanism. The second part couples to the removal and depositing devices and remains fixed relative to the particular location where the bottles leave the conveyor.

The moving and stationary components of the guiding mechanism maintain the bottles directed from the conveyor by the removal device on a first path and the bottles replaced on the conveyor by the depositing device on a second path. The guiding mechanism specifically keeps the two paths of the bottles coming on and off of the handling equipment clear of each other.

Typically, the stationary portion of the guiding mechanism will incorporate a guide rail or a form that will establish the paths which the bottles will travel when entraining upon or departing from the moving mechanism. These paths, of course, must not conflict with each other.

The moving portion of the guiding mechanism will most usually utilize extensions of paddles forming part of the moving mechanism. These extended paddles make certain that the bottles moving onto or off of the moving mechanism follow the paths established by the guide rails. Without these extended paddles, the bottles could well become jammed either at the entrance or the exit of the moving mechanism.

More generally, the container washing or handling equipment may include a moving mechanism which moves the bottles from the conveyor along a second route different than the first route they followed while on the conveyor. The route followed by the containers while removed from the conveyor may, in fact, include a plurality of arcs each extending substantially 360 degrees in a particular plane about an axis. Moving these bottles several times through substantially full-circle rotations in different planes allows the performance of a multitude of operations upon them.

The guiding mechanism in this instance should establish a first path for bottles beginning each rotation and a second path for bottles completing each rotation. To avoid the usual jamming where the bottles enter and leave each rotation, the guiding mechanism should keep the first and second paths clear of each other so that the departing bottles will not collide with the entering bottles.

For this type of mechanism which employs several rotations, the operator may have other purposes that he needs to accomplish than cleaning the bottles. In this case, the equipment will not incorporate the usual cleaning stations. Rather, it will include the equipment necessary to carry out the different functions as desired by the operator.

The method for cleaning bottles transported along a first route on a conveyor involves first directing the bottles off the conveyor at a particular location. These bottles are then moved along a second route different from the first route of the conveyor and includes a plurality of substantially 360 degree rotations in adjacent, separate planes about an axis.

The cleaning of the bottles then occurs. Naturally, should the operator have other operations in mind, he could well omit the cleaning step.

Bottles beginning each of the rotations are guided along a first path and the bottles ending that rotation are guided along a second path. These two paths are kept separate from each other. Lastly, the bottles return to the conveyor.

BRIEF DESCRIPTION OF THE FIGURES

FIG. 1 gives an isometric view of a bottle washer which may sit over a conveyor line and wash bottles removed from the conveyor line and replace those bottles on the conveyor.

FIG. 2 gives a cross-sectional view along the line 2—2 of the bottle washer of FIG. 1.

FIG. 3 gives a cross-sectional view along the line 3—3 of the bottle washer of FIG. 2.

FIG. 4 displays a washer accepting bottles from a conveyor belt and subjecting them to a single rotation of substantially 360 degrees for cleaning.

FIG. 5 provides a plan elevational view of a valve cup finding particular usefulness for the two orbit bottle washer of FIGS. 1, 2, and 4.

FIG. 6 depicts a valve plate that may find use with the valve cup of FIG. 5.

FIG. 7 gives a cross-sectional view along the line 7—7 of the valve cup of FIG. 5 and the valve plate of FIG. 6 combined together to show the operation of the resulting valve.

FIG. 8 shows a simple valve plate for use with a bottle washer such as seen in FIG. 4 which rotates the bottles about a single arc of 360 degrees.

DETAILED DESCRIPTION

FIG. 1 shows a bottle washer generally at 10 composed of the stand 11 and the drum portion 12. The stand 11, in turn, includes the controls 13 and another section, not seen, lying on the other side of the washer 10.

In general, the washer 10 sits over the conveyor line 14 which usually forms no part of the washer 10. As appears more clearly in FIG. 2, the bottles 15 move along the conveyor 14. Eventually, they reach the rail 16 which pushes them against the screw auger 17. Both the rail 16 and the auger 17 form part of the equipment typically provided with the bottle washer 10.

The auger 17 has proven desirable for controlling the flow of the bottles 15 to the washer 10 under several circumstances. These include the instances where the conveyor 14 provides ether a large number of bottles rapidly or noncircular bottles, especially with oval or rectangular shapes. Otherwise, the conveyor 14 itself would provide the bottles to the washer 10 between the rail 16 and another rail on the other side of the conveyor 14 which would take the place of the auger 17.

The bottles 15 enter through the opening 19 in the face plate 20. There one or more at a time may become entrained between the paddles 21 of the first, or upstream, orbit 22. The front edge 23 of the guide plate 24 directs the bottles 15 entering through the opening 19 into the space between the paddles 21 of the first orbit 22.

In operation, the paddles 21 rotate in a clockwise direction as seen in FIG. 1, which means that, in FIG. 2, they travel right to left. As they do so, of course, they take the bottles 15 with them.

When the bottles begin their circular arc, as seen in particular in FIG. 3, the bottle lift guide 28 moves them toward the center of the drum 11 where they will undergo cleaning. The screws 29 permit the adjustment of the bottom lift guide 28 to place the bottles 15 at the appropriate distance from the center of the drum 11. This permits their efficient cleaning and drying.

FIG. 3 shows more clearly that the bottles 15 enter the drum 11 through the opening 19 in the face plate 20. Once inside, the paddles 21, acting under the impetus of a motor, move the bottles in a clockwise direction. Shortly after entering the first orbit 22, the bottoms 31 of the bottles 15 make contact with the bottle lift guide 28 which forces them towards the center of the drum 11. The continued movement of the bottles 15 in the clockwise direction results in the bottle lift guide 28 lifting the bottles towards the center until the bottle necks 32 make contact with the centering guide 33. The centering guides 33 position the bottle necks 32 so that, as the bottle guide 28 moves them towards the center, the tubes 34 enter the bottle mouths 35. Each tube 34 will enter into the mouth 35 of a single bottle 15 and remain with that bottle throughout the entire rotation of almost 360 degrees. As discussed below, fluids such water, cleaning solution if necessary, air, and the like enter the bottle 15 through the tube 34 to effectuate the desired cleaning.

In FIG. 3, the bottles receive a water rinse for approximately 110 degrees of their rotation as indicated by the arc 39. Subsequently, the bottles, through approximately 85 degrees of arc 40 become substantially inverted Air enters to dry the bottles. Any water contained inside has the opportunity to drain from them. The drops of water leaving the bottles fall onto the collection pan 41 and subsequently leave through the drain 42.

Eventually, the bottles on the first orbit 22 seen in FIG. 4 complete nearly 360 degrees of rotation. As they do so, they will eventually contact the trailing edge 43 of the guide plate 24.

However, the paddles 21 of the first orbits 22 continue to move the bottles 15 to the left as seen in FIG. 2. The guide plate 24 will consequently force the bottles to move downward, as seen there, where they will begin to make contact with the paddles 44 of the second orbit 45.

Thus, the combined action of the paddles 21 of the first orbit 22 and the paddles 44 of the second orbit 45 cause the bottles 15 to move against the trailing edge 43 of the guide plates 24 and shift from the first orbit 22 to the second orbit 45. To provide for this transition, of course, each paddle 44 of the second orbit 45 must connect to and move with a paddle 21 of the first orbit 22. This provides a convenient opening for each bottle 15 to move into when it transfers from the first orbit 22 to the second orbit 45. Furthermore, it provides continuous guiding action for the bottles 15 as they make contact with and move along the trailing edge 43 of the guide plate 24.

The leading edge 50 of the guide plate 49 also makes contact with the bottles 15 undergoing this transfer. The edge 50 also helps in directing the bottles into the second orbit 45.

While in the second orbit 45, the bottles may undergo further cleaning operations as required. They may receive further rinsing and additional air in order to provide the clean, dry bottles required for subsequent operations. Eventually, the bottles in the second orbit 45 will complete about 360 degrees of rotation in that orbit. In other words, they will have completed substantially two revolutions since entering the bottle washer 10. At this point, they will reach the trailing edge 51 of the second guide plate 49. The guide plate 51 will help direct the bottles 15 out of the second orbit 45 and back on to the conveyor 14 as seen in FIG. 2. Thus, they leave the washer 10 through the opening 52 in the rear plate 53. From there, the bottles enter onto the conveyor and receive the assistance of the guide rails 54 and in moving onto the next operation.

However, the trailing edge 51 of the second guide plate 49 does not always suffice to provide complete assurance that the bottles leaving the second orbit 45 will all properly find their way on the conveyor 14 and move away from the cleaner 10. To ameliorate this shortcoming, the paddles 44 possess considerably greater length than the width of the bottles 15. In particular, the extensions 56 to the paddles 44 lie beyond the bottles towards the end plate 53 by a length at least about 50 percent of the width of the bottles or even more. The extensions 56 on the paddles 44 serve to continue guiding the bottles 15 against the trailing edge 51 of the guide plate 49 even after they leave the domain of the second orbit 45. This continual guiding provided by the extensions 56 of the paddles 44 make sure that the bottles 15 properly reach the conveyor 14 which will carry them to the next operation.

As seen in FIG. 2, the bottles, while rotating about the axis 61 (seen in FIG. 1) of the cleaner 10 must undergo two lateral transportations. First, they pass through the opening 62 in the barrier 63 and later travel from the first orbit 22 to the second orbit 45. In the latter case, the trailing edge 43 of the guide plate 24 acting in conjunction with the paddles 21 and 44 guide and move the bottles 15 between the two orbits 22 and 45.

Subsequently, the bottles reach the conclusions of their second revolution. Then, the paddles 44 with their extensions 56 guide and move the bottles 15 from the second orbit 55 through the opening 64 in the barrier ring 65, through the opening 52 in the rear face plate 53, and onto the conveyor 14.

The equipment in FIG. 3 may accommodate bottles of different sizes. Initially, the screws 29 permit the adjustment of the bottle lift guide 28 to accommodate bottles of different heights. Additionally, replacing the paddles 21 and 44 along with the barrier 63 between them will allow the accommodating of bottles of different widths. The rear face plate 53 may find use on bottles with different widths. However, the annular ring 65 sits between the upper halves 69 and the lower halves 70 of the extensions 56 of the second orbit paddles 44 and is supported by the rods 68. Requiring a different retaining barrier ring 65 of a different radius may involve changing the end face plate 53 as well.

The same principles of guiding bottles off a conveyor onto a rotating washer, and back onto a conveyor apply to the simpler, single revolution, system indicated generally at 81 in FIG. 4. There, the bottles 15 pass along the conveyor line 82 between the guard rails 83. They then enter through the opening 84 in the face plate 85 and reach the sole rotational orbit 86 of the cleaner 81. The front edge 91 of the guide plate 92 directs the bottles from the entrance 84 into the orbit 86. The paddles 93 move the bottles from the opening 84 into the orbit 86 and around a 360 degree arc of rotation for their cleaning and drying.

As the bottles 15 complete their single orbit 86 in the cleaner 81, they make contact with the trailing edge 97 of the guide plate 92. The trailing edge 97 directs the departing bottles 15 away from the bottles entering through the opening 84. Thus, the departing bottles travel through the opening 98 in the ring barrier 99 and through the opening 100 in the end face plate 101. They then pass onto the conveyor 82 between the guard rails 104.

As with the paddle extensions 56 in FIGS. 1 to 3, the extensions 105 to the paddles 93 cause the bottles 15 departing from the orbit 86 to continue their rotational movement even when contacting the trailing edge 97 of the guide plate 92. The extensions 105, in fact, continue to move the bottles until they reach the conveyor 82.

Without the extensions 105, the bottles 15 would leave the orbit 86 under the direction of the trailing edge 97 before reaching the conveyor 82. A jamming of the bottles could result. However, the paddle extensions 105 continue to move the bottles, which have left the orbit 86, to avoid the path of the incoming bottles prior to reaching the conveyor 82. Yet, the paddle extensions 105, in fact, move the bottles, even though out of the orbit 86, until they become safely ensconced on the conveyor 82.

The valve cup indicated generally at 111 of FIG. 5 and the valve plate 112 in FIG. 6 may combine in the usual fashion as shown in FIG. 7. They provide the fluids required for the cleaning of the bottles by the washer 11 of FIGS. 1 to 3.

The valve plate 112 typically remains stationary in the washer. The fluids for the first orbit appear in the depressions 113, 114, and 115 through the openings 116 to 119. Similarly, the fluids for the second orbit appear in the depressions 122 and 123 through the openings 124 to 126.

The holes 127 permit the passage of screws for the usual connections of the valve plate 112. The axis 61 of the washer 11 in FIG. 1 passes through the opening 128 in the center of the valve plate 112.

As seen in FIG. 7, the valve cup 111 receives the valve plate 112. However, the cup 111 rotates with the paddles 21 and 44 as they move the bottles 15 through their orbits.

The valve cup 111 includes the openings 131 to 146 which lie in fluid communication with the ducts 147 to 162, each of which connects to one of the tubes 34 as seen in FIG. 3. While any one of the openings 131 to 146 remains aligned with one of the depressions 113 to 115, the fluid provided by the respective opening of the aligned depression may pass through the mating opening of the valve cup 111. It will then flow through the adjoined duct to the connecting tube 34 to provide the appropriate bottle with the indicated fluid. Thus, as seen in FIG. 7, the fluid passing through the opening 118, which may take the form of air provided by the conduct 163 in FIG. 1, fills the depression 114 The opening 131 in the valve cup 111 receives the air which then travels through the duct 147 to the tube 34 in communication with it. The tube 34 in communication with the duct 147 would typically point in a generally upward the direction since the opening 131 must rotate into alignment with the depression 114 near the top of the cycle.

Similarly, the valve cup 111 includes the openings 165 to 180 which will align, during the rotation of the cup 111, with the depressions 122 and 123 in the valve plate 112. While each of the openings 163 to 178 remains aligned with the depressions 122 and 123 as the cup 111 rotates, the fluid provided in those depressions will pass through the respective openings in the cup 111 to the ducts aligned behind them. The fluid can then flow through the connecting tubes which enter the bottles in the second orbit 45 of FIG. 2.

Thus, when the valve cup 111 occupies the position shown in FIGS. 5 and 7, the opening 163 aligns with the depression 123 and receives the fluid provided by the openings 125 and 126. This fluid passes through the duct 181 to the tube inserted in the bottle lying at the top of the second orbit. In comparison, the opening 171 does not align with any depression and receives no fluid to which it can pass to the duct 182.

As seen in FIGS. 5 and 7, the valve cup 111 includes the shoulder 185 into which the valve plate 112 fits. The bevelled corner 187 facilitates the insertion of the valve plate 112 into the cup 111. Additionally, the openings 187 permit the passage of screws or bolts to keep the valve cup 111 in place. The installation of the valve cup 111 involves placing it in the drum 11 with the axis 61 passing through the cup's central opening 188.

Lastly, the annular groove 189 in the valve cup 111 permits the collection of fluids that may seep from the depressions 113 to 115 or 122 and 123. Alternately, to provide a positive seal between the depressions 113 to 115 for the first orbit from those 122 or 123 of the second orbit, the groove 189 may accommodate an O-ring seal.

FIG. 8 shows a simple valve plate 192 useful for the single orbit washer 81 of FIG. 4. That valve plate 192 includes the two depressions 193 and 194 fed with the appropriate fluids by the openings 195 and 196. As suggested by FIG. 8, an appropriate valve cup connects to the tubes feeding the bottles 15 on the orbit 86 and displays openings which will align with the depressions 193 and 194 on the plate 192. The depression 193 will provide water to the appropriate openings and thence their tubes throughout the 60 degree arc 197. Along the arc 198 of 120 degrees, the tubes will provide the bottle with air which fills the depression 194.

What is claimed is:

1. In a bottle washer for cleaning bottles moving in a particular direction on a conveyor including:
   (1) removal means for directing bottles on said conveyor off said conveyor at a particular location;
   (2) capture means, coupled to said removal means, for receiving bottles directed by said removal means;
   (3) moving means, coupled to said capture means, for rotating said received bottles about an arc of substantially 360 degrees in a single plane about an axis;
   (4) washing means, coupled to said moving means, for cleaning said bottles while rotating about said arc; and
   (5) depositing means, coupled to said moving means, for replacing bottles rotated by said moving means on said conveyor, the improvement comprising guiding means, coupled to said removal means, said moving means, and said depositing means, said guiding means being composed of a first part coupled to and rotating about said arc with said moving means and a second part coupled to said removal means and said depositing means and remaining fixed relative to said particular location, for keeping the bottles directed from said conveyor by said removal means on a first path and the bottles replaced on said conveyor by said depositing means on a second path and maintaining said first and second paths clear of each other.

2. The improvement of claim 1 wherein said moving means includes several paddles making contact with said bottles and moving about in said substantially 360 degree arc and said first part of said guiding means includes extensions on said paddles in the direction of said axis extending substantially beyond the space occupied by said bottles while in said arc by an amount equal to at least about half of the cross-sectional area of said bottles.

3. The improvement of claim 2 wherein said guiding means moves said bottles out of said plane immediately prior to said bottles reaching the completion of said substantially 360 degree arc.

4. The improvement of claim 3 wherein said second part of said guiding means includes a guide structure placed in the path of said bottles substantially completing substantially 360 degree arc and directing said bottles onto said conveyor.

5. The improvement of claim 4 wherein said axis lies substantially parallel to said particular direction.

6. In a bottle washer for cleaning bottles moving along a first route on a conveyor including:

(1) removal means for directing bottles on said conveyor off said conveyor at a particular location;

(2) capture means, coupled to said removal means, for removing bottles directed by said removal means;

(3) moving means, coupled to said capture means, for moving said received bottles along a second route different than said first route;

(4) washing means, coupled to said moving means, for cleaning said bottles while moving along said second route; and (5) depositing means, coupled to said moving means, for replacing bottles moved by said moving means on said conveyor, the improvement wherein said second route includes a plurality of substantially 360 degree rotations about an axis, each of said rotations lying in a separate plane, said separate planes being adjacent to each other, and wherein said washer further includes guiding means, coupled to said removal means, said moving means, and said depositing means, for establishing, for each one of said 360 degree rotations, a first path for bottles beginning said one rotation and a second path for bottles completing said one rotation and maintaining said first and second paths clear of each other.

7. The improvement of claim 6 wherein said guiding means includes, for each of said 360 degree rotations, a first part coupled to and rotating about said arc with said moving means and a second part, coupled to said removal means and said depositing means and remaining fixed relative to said particular location.

8. The improvement of claim 7 wherein said moving means includes, for each one of said rotations, several paddles making contact with said bottles and moving about in said substantially 360 degree arc and said first part of said guiding means includes extensions on said paddles in the direction of said axis extending substantially beyond the space occupied by said bottles in said plane of said one rotation while in said arc by an amount equal to about half of the cross-section area of said bottles.

9. The improvement of claim 8 wherein said guiding means moves said bottles out of said plane of said one rotation immediately prior to said bottles reaching the completion of said substantially 360 degree arc.

10. The improvement of claim 9 wherein, for two substantially 360 degree rotations in adjacent planes, the extensions of said paddles of one of said two rotations forms the paddles for the other of said two rotations.

11. The improvement of claim 10 wherein, for each one of said rotations, said guiding means moves said bottles of said plane of said one rotation immediately prior to said bottles reaching the completion of said substantially 360 degree arc.

12. The improvement of claim 11 wherein, for said two rotations in said adjacent planes, each of the paddles in one of said two rotations is connected to and moves with one of the paddles in the other of said two rotations.

13. The improvement of claim 12 wherein said axis lies substantially parallel to said particular direction.

14. In bottle handling equipment for moving bottles traveling in a particular direction on a conveyor including:

(1) removal means for directing bottles on said conveyor off said conveyor at a particular location;

(2) capture means, coupled to said removal means, for removing bottles directed by said removal means;

(3) moving means, coupled to said capture means, for rotating said received bottles about an arc of substantially 360 degrees in a single plane about an axis; and (4) depositing means coupled to said moving means, for replacing bottles rotated by said moving means on said conveyor, the improvement comprising guiding means coupled to said removal means, said moving means, and said depositing means, said guiding means being composed of a first part coupled to and rotating about said arc with said moving means and a second part coupled to said removal means and said depositing means and remaining fixed relative to said particular location for keeping the bottles directed from said conveyor by said removal means on a first path and the bottles replaced on said conveyor by said depositing means on a second path and maintaining said first and second paths clear of each other.

15. The improvement of claim 14 wherein said moving means includes several paddles making contact with said bottles and moving about in said substantially 360 degree arc and said first part of said guiding means includes extensions on said paddles in the direction of said axis extending substantially beyond the space occupied by said bottles while in said arc by an amount equal to at least about half of the cross-section area of said bottles.

16. The improvement of claim 15 wherein said guiding means moves said bottles out of said plane immediately prior to said bottles reaching the completion of said substantially 360 degree arc.

17. The improvement of claim 16 wherein said second part of said guiding means includes a guide structure placed in the path of said bottles substantially completing substantially 360 degree arc and directing said bottles onto said conveyor.

18. The improvement of claim 17 wherein said axis lies substantially parallel to said particular direction.

19. In bottle handling equipment for moving bottles along a first route on a conveyor including:

(1) removal means for directing bottles on said conveyor off said conveyor at a particular location;

(2) capture means, coupled to said removal means, for removing bottles directed by said removal means;

(3) moving means, coupled to said capture means, for moving said received bottles along a second route different than said first route; and (4) depositing means, coupled to said moving means, for replacing bottles moved by said moving means on said conveyor, the improvement wherein said second route includes a plurality of substantially 360 degree rotations about an axis, each of said rotations lying in a separate plane, said separate planes being adjacent to each other, and wherein said washer further includes guiding means, coupled to said removal means, said moving means, and said depositing means for establishing, for each one of said 360 degree rotations, a first path for bottles beginning said one rotation and a second path for bottles completing said one rotations and maintaining said first and second paths clear of each other 20. The improvement of claim 19 wherein said guiding means includes, for each of said 360 degree rotations, a first part coupled to and rotating about said arc with said moving means and a second part, coupled to said removal means and said depositing means and remaining fixed relative to said particular location.

21. The improvement of claim 20 wherein said moving means includes, for each one of said rotations, several paddles making contact with said bottles and moving about in said substantially 360 degree arc and said first part of said guiding means includes extensions on said paddles in the direction of said axis extending substantially beyond the space occupied by said bottles in said plane of said one rotation while in said arc by an amount equal to at least about half of the cross-section area of said bottles.

22. The improvement of claim 21 wherein said guiding means moves said bottles out of said plane of said one rotation immediately prior to said bottles reaching the completion of said substantially 360 degree arc.

23. The improvement of claim 22 wherein for two substantially 360 degree rotations in adjacent planes, the extensions of said paddles of one of said two rotations forms the paddles for the other of said two rotations.

24. The improvement of claim 23 wherein, for each one of said rotations, said guiding means moves said bottles out of said plane of said one rotation immediately prior to said bottles reaching the completion of said substantially 360 degree arc.

25. The improvement of claim 24 wherein, for said two rotations in said adjacent planes, each of the paddles in one of said two rotations is connected to and moves with one of the paddles in the other of said two rotations.

26. The improvement of claim 25 wherein said axis lies substantially parallel to said particular direction.

* * * * *